US008238596B2

(12) United States Patent
Blanchard et al.

(10) Patent No.: US 8,238,596 B2
(45) Date of Patent: Aug. 7, 2012

(54) IN-EAR HEADPHONES

(75) Inventors: Mark A. Blanchard, Lebanon, IN (US); Bradley C. Geswein, Plainfield, IN (US)

(73) Assignee: Klipsch Group, Inc., Indianapolis, IN (US)

( * ) Notice: Subject to any disclaimer, the term of this patent is extended or adjusted under 35 U.S.C. 154(b) by 654 days.

(21) Appl. No.: 12/316,153

(22) Filed: Dec. 10, 2008

(65) Prior Publication Data

US 2009/0147981 A1 Jun. 11, 2009

Related U.S. Application Data

(60) Provisional application No. 61/012,482, filed on Dec. 10, 2007.

(51) Int. Cl.
*H04R 25/00* (2006.01)

(52) U.S. Cl. ..... 381/380; 381/324; 381/325; 381/351; 381/370; 381/371

(58) Field of Classification Search ..... 381/380, 381/351; 281/380, 351, 324–325, 370, 371
See application file for complete search history.

(56) References Cited

U.S. PATENT DOCUMENTS

| | | | | |
|---|---|---|---|---|
| 3,906,170 | A * | 9/1975 | Guice | 381/322 |
| 6,681,023 | B1 * | 1/2004 | Turnbull et al. | 381/369 |
| 2003/0138111 | A1 * | 7/2003 | Cheng | 381/71.7 |
| 2006/0133636 | A1 * | 6/2006 | Harvey et al. | 381/380 |
| 2006/0153418 | A1 * | 7/2006 | Van Halteren | 381/396 |
| 2007/0009120 | A1 * | 1/2007 | Algazi et al. | 381/310 |
| 2010/0310106 | A1 * | 12/2010 | Blanchard et al. | 381/351 |

OTHER PUBLICATIONS

The International Bureau of WIPO. Notification Concerning Transmittal of International Preliminary Report on Patentability (Chapter I of the Patent Cooperation Treaty). Jun. 24, 2010.

* cited by examiner

*Primary Examiner* — A. Sefer
(74) *Attorney, Agent, or Firm* — Krieg De Vault LLP

(57) ABSTRACT

An earphone is disclosed that is used in connection with reproducing audio sounds that are supplied from an audio-frequency source. The earphone includes a housing that includes a boot assembly positioned in the housing. A first audio driver is positioned in the boot assembly such that a first output of the first audio driver is in acoustic communication with a mixing chamber. A second audio driver is also positioned in the boot assembly such that a second output of the second audio driver is in acoustic communication with a chamber in the boot assembly. A tubular needle is positioned in the boot assembly having a first end in acoustic communication with the chamber and a second end in acoustic communication with the mixing chamber.

37 Claims, 20 Drawing Sheets

IN-EAR HEADPHONES

CROSS REFERENCE TO RELATED APPLICATIONS

The present application claims the benefit of and priority to U.S. provisional patent application No. 61/012,482 filed on Dec. 10, 2007, which is incorporated herein by reference in its entirety.

FIELD OF THE INVENTION

The present invention relates generally to earphones and hearing aids for audio playback or reinforcement and more particularly, to an earphone that includes two drivers and a tube functioning as a low pass filter.

BACKGROUND

Headphones, personal monitors, in-ear monitors, earphones, earbuds and hearing aids are a pair of loudspeakers that are configured to be positioned close to a user's ear drums or in a user's ear canal with a means for connecting them psycho-acoustically to an audio source. Headphones are commonly used with electronic equipment such as CD or DVD players, home theater systems, personal computers, as well as portable electronic devices such as portable music players, mobile phones, and so forth. Wired headphones attach to the audio source and typically use a common connector known as a stereophonic jack to be connected to the audio source. Some headphones fit over the outer portion of a user's ear and other headphones are designed to fit within an outer part of the ear canal of the user. In addition, some are designed to fit in the ear canal close to the ear drum. Headphones that are designed to fit within the outer part of the ear canal are commonly referred to as earbuds and headphones which occlude and reside in the ear canal are considered in ear monitors, personal monitors and canal phones.

SUMMARY

One embodiment of the present application discloses an in-ear headphone system or assembly containing two acoustic drivers per ear. Other embodiments include unique apparatus, devices, systems, and methods for reproducing electric audio signals in earphones or hearing aids. Further embodiments, forms, objects, features, advantages, aspects, and benefits of the present application shall become apparent from the detailed description and figures included herewith.

BRIEF DESCRIPTION OF THE DRAWINGS

The figures are not necessarily to scale, emphasis instead being placed upon illustrating the principles of the invention. Moreover, in the figures, like reference numerals designate corresponding parts throughout the different views.

DETAILED DESCRIPTION

Figure 1:
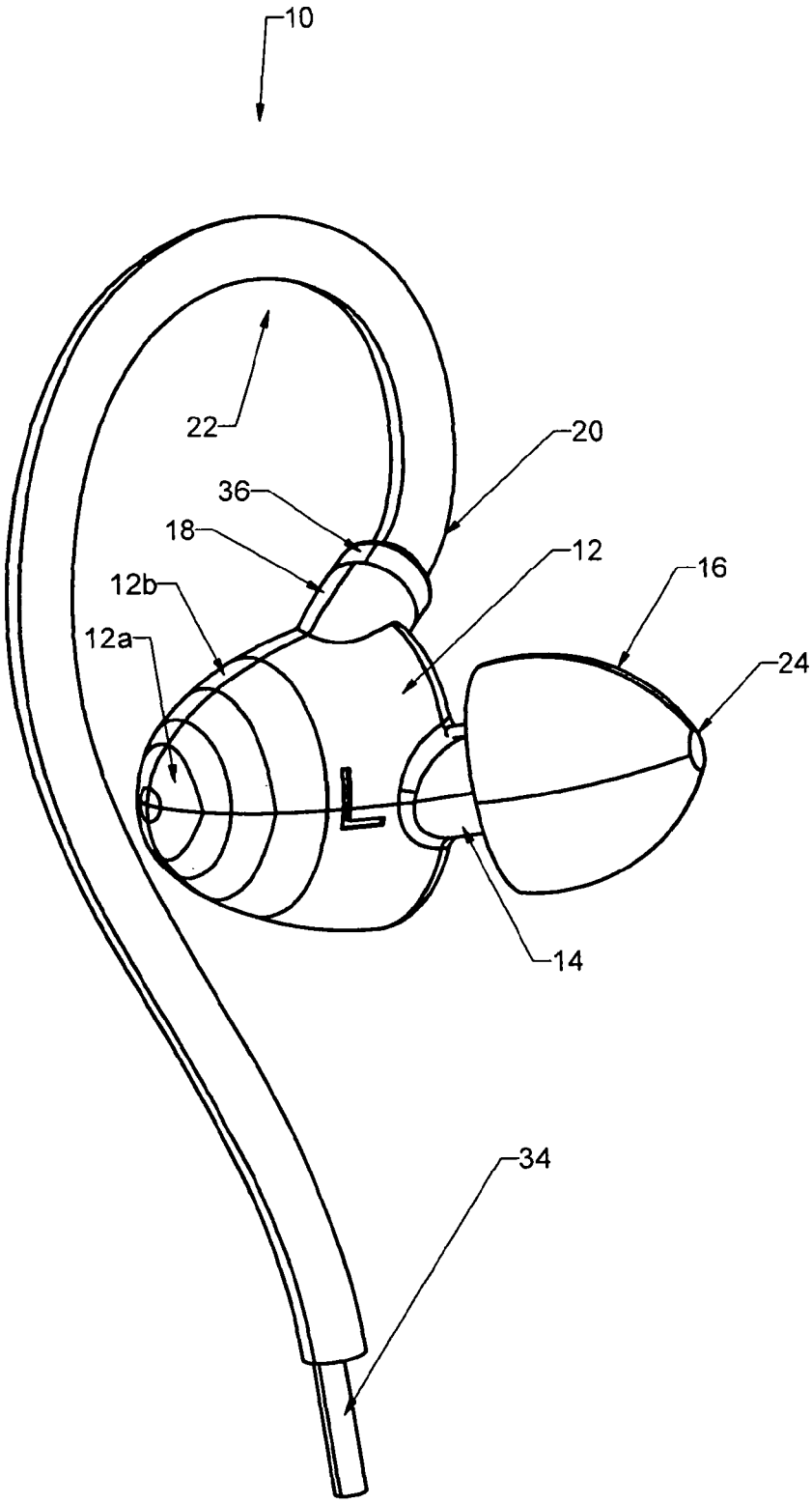
FIG. 1 is a perspective view of a representative earphone.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention is illustrated therein being contemplated as would normally occur to one skilled in the art to which the invention relates.

Figure 2:
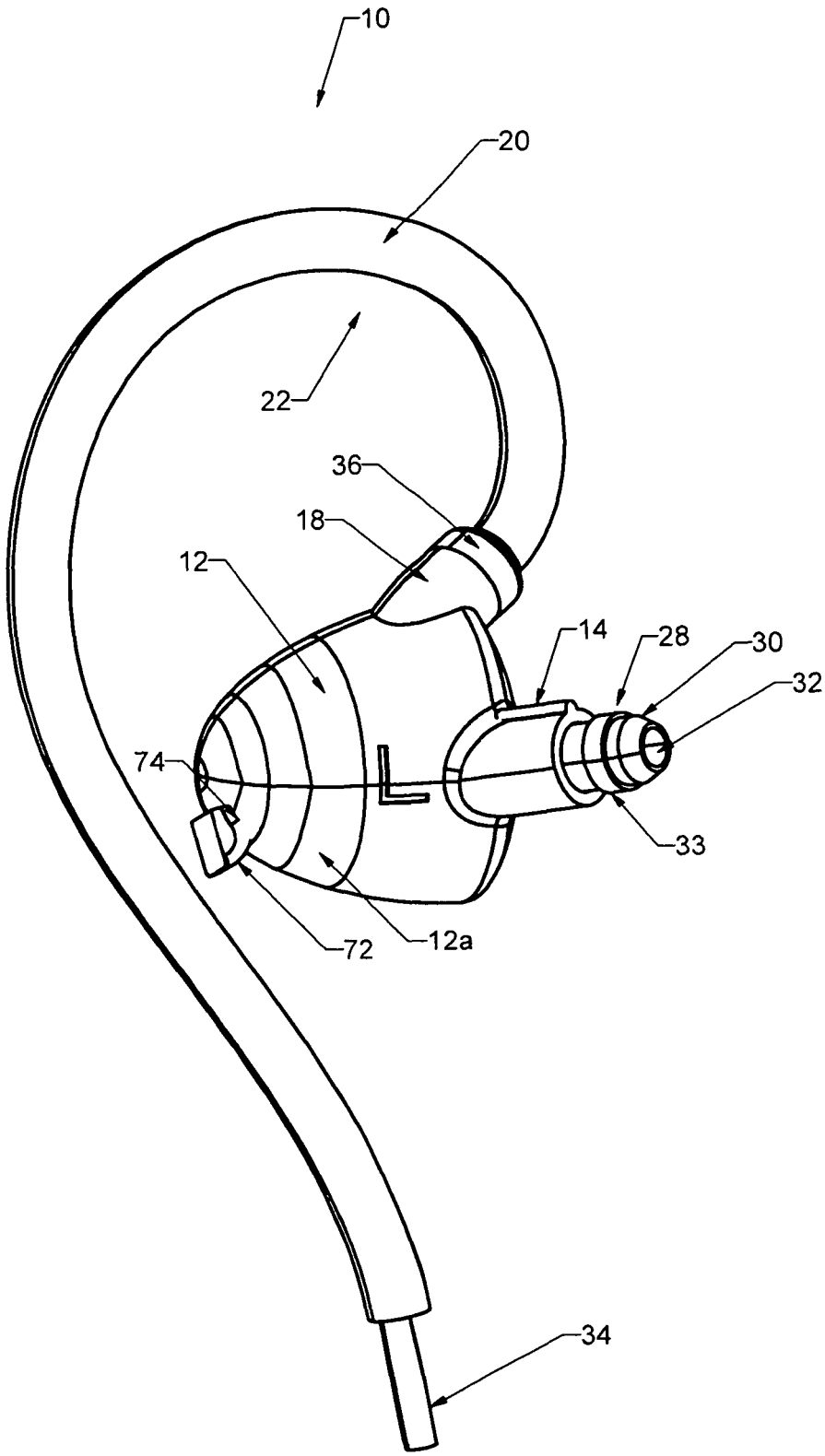
FIG. 2 is a perspective view of another representative earphone.

Referring to FIGS. 1 and 2, an in-ear earphone or canal phone 10 is disclosed that is configured and operable to convert electric audio signals supplied by an audio source into audible sound. The earphone 10 includes a housing 12 that contains components configured to reproduce audible sounds. Housing 12 includes a rear portion or cover 12*a* and a front portion or cover 12*b* of housing 12. An end of housing 12 includes a generally tubular shaped nozzle housing 14 that protrudes outwardly from a forward surface of housing 12. A front end of nozzle housing 14 includes a detachable ear tip 16 that is removably connected with the front end of nozzle housing 14, as set forth in greater detail below.

In one form, detachable ear tip 16 comprises one of the illustrative ear tips disclosed in U.S. patent application Ser. No. 11/584,862 filed on Oct. 23, 2006 entitled "Ear Tip", which is incorporated herein by reference in its entirety. Although not illustrated, two earphones 10 are included in the preferred form, but only one earphone 10, in this case a left earphone 10, has been illustrated for the sake of clarity. Ear tips 16 are preferentially made from a flexible rubber type of material, such as silicone, so that they are capable of conforming to the contour of the inner ear canal of a user of earphone 10. However, other types of suitable material may be used to form ear tips 16.

An upper end of housing 12 includes a tubular extension 18 that protrudes upwardly and outwardly from the upper end of housing 12. A sleeve 20 extends outwardly from extension member 18 and, as set forth in greater detail below, a portion of sleeve 20 forms an ear hook assembly 22 that fits around the upper pinna or auricle portion of the outer ear of a user of earphone 10. In one form, sleeve 20 comprises a thermo set resin made of polyethylene ("PE") cable tube. Ear hook assembly 22 is used to help secure earphone 10 to the ear of the user. Ear tip 16 fits within the outer ear canal of the user of earphone 10 and includes an output port 24 that is used to transmit audible sounds or frequencies to the ear of the user.

As illustrated in FIG. 2, nozzle housing 14 includes a nozzle 28, a lower portion of which is positioned inside at least a portion of nozzle housing 14. Nozzle 28 has an upper tapered connection member 30 and a port or passageway 32 that runs through the entire interior portion of nozzle 28. Nozzle 28 also includes a rib 33 that is used to secure ear tip 16 to the portion of nozzle 28 that protrudes outwardly from nozzle housing 14. In this form, nozzle housing 14 and nozzle 28 have a generally circular shaped cross-sectional configuration. However, it should be appreciated that other shapes and configurations may be utilized in alternative forms, such as elliptical, rectangular, square, and triangular, to name a few. As previously set forth, an interior portion of ear tip 16 is removably connected with a portion of nozzle 28. Output port 24 of ear tip 16 is aligned with port 32 of nozzle 28. A flexible audio cable 34 is positioned inside sleeve 20 that includes audio wires that are used to provide electric audio signals to earphone 10. A ring 36 is positioned around an upper portion of extension 18 and serves as a clamping member to hold covers 12*a*, 12*b* together.

Figure 3:
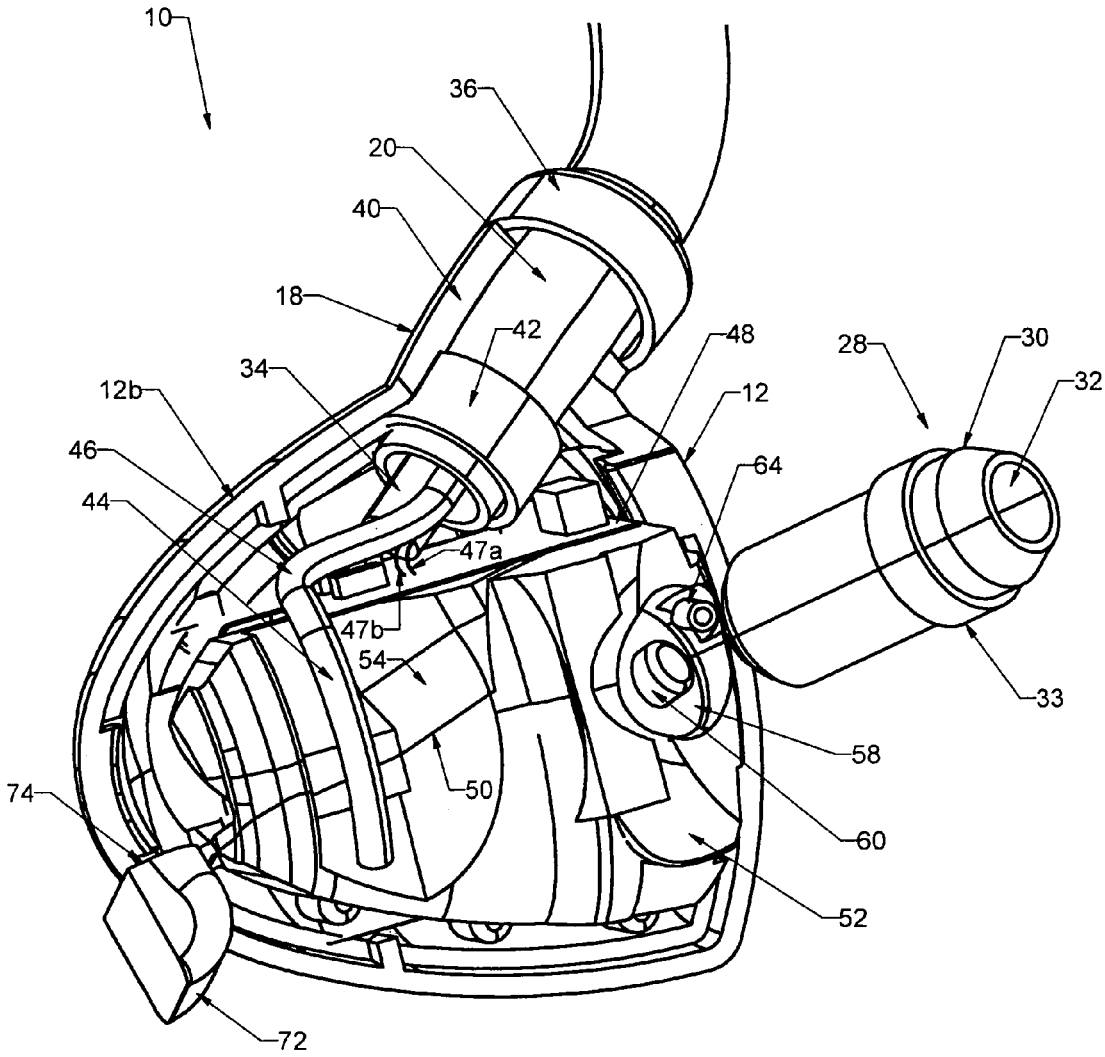
FIG. 3 is a perspective view of the earphone illustrated in FIG. 2 with a rear cover removed from a housing.

Referring to FIG. 3, rear portion or cover 12*a* of housing 12 has been removed from housing 12. As illustrated, housing 12 includes a front portion or cover 12*b* that is connected with rear portion 12*a* of housing 12. Sleeve 20 is positioned within an aperture or passageway 40 defined by extension member 18. A copper ring 42 is positioned within a portion of passageway 40 of housing 12 to prevent or inhibit movement of ring 42 within housing 12. Sleeve 20 passes through a central portion of ring 42 and is connected to ring 42 such that sleeve 20 is snugly secured within the central portion of ring 42. Sleeve 20 may be connected to ring 42 by a friction fit or using conventional connection mechanisms such as adhesive or clamping for example.

Figure 4:
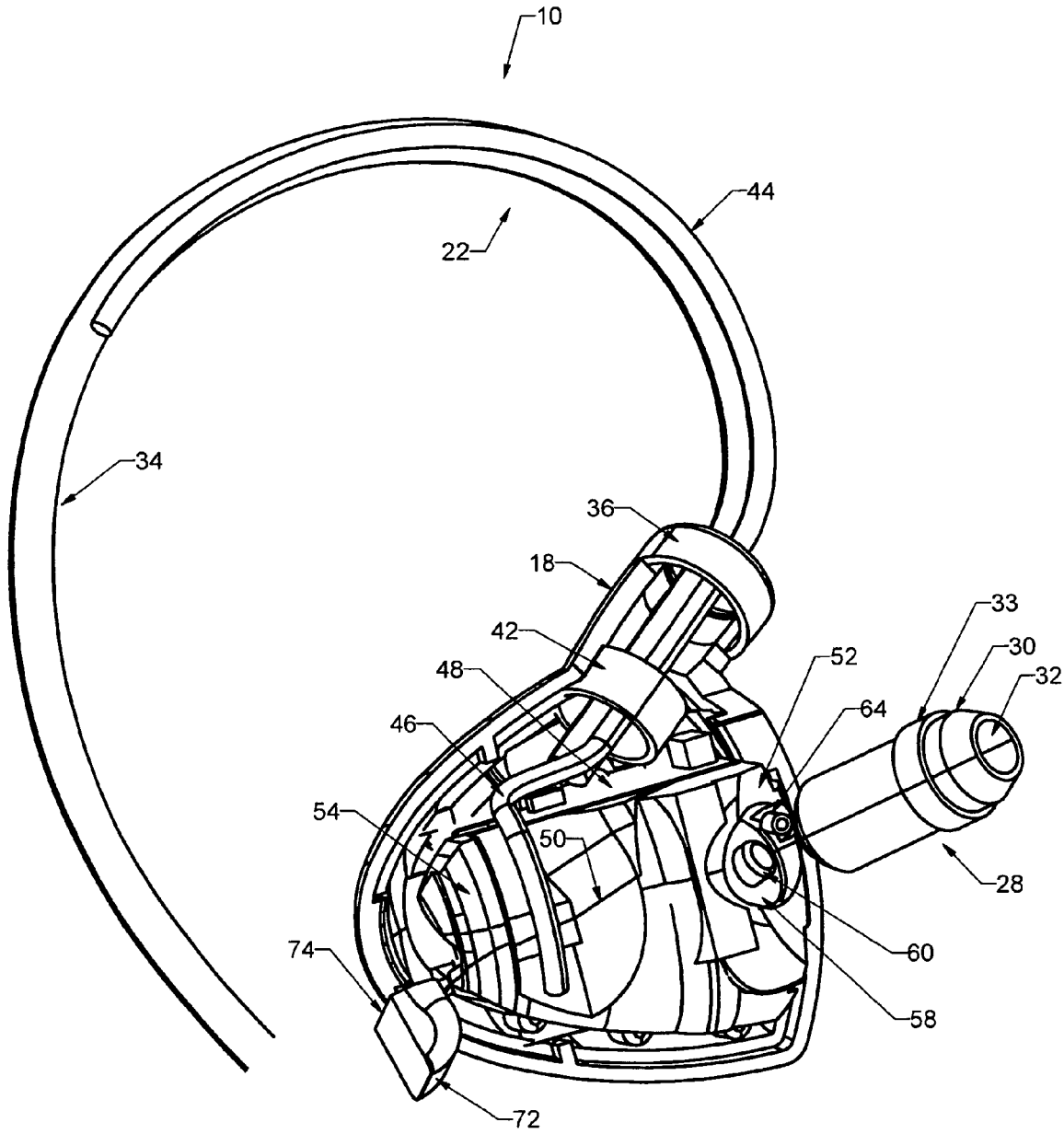
FIG. 4 is a perspective view of the earphone illustrated in FIG. 3 with a cable cover removed.

Referring collectively to FIGS. 3 and 4, a flexible wire or gumby wire 44 is also positioned inside sleeve 20 and housing 12. In particular, flexible wire 44 and sleeve 20 form ear hook assembly 22. See also FIG. 1. Flexible wire 44 is capable of bending to take on desirable shapes, in this case the shape of the upper portion of the ear of a user of earphone 10, to help secure earphone 10 to the head of a user. As such, ear tip 16 and ear hook assembly 22 cooperate with one another to secure earphone 10 to the user.

A portion of flexible wire 44 fits within housing 12 through extension member 18 into an interior portion defined by housing 12 and includes a bend 46 that directs flexible wire 44 downwardly a predetermined distance into housing 12. Audio cable 34 protrudes outwardly from sleeve 20 and includes audio wires 47*a*, 47*b* that are connected to a flexible circuit board 48, which is discussed in greater detail below. In one form, audio cable 34 comprises a flexible fabric jacketed audio cable that includes conductive wires (e.g.—audio wires 47*a*, 47*b*) surrounded by a fabric material.

Figure 5A:
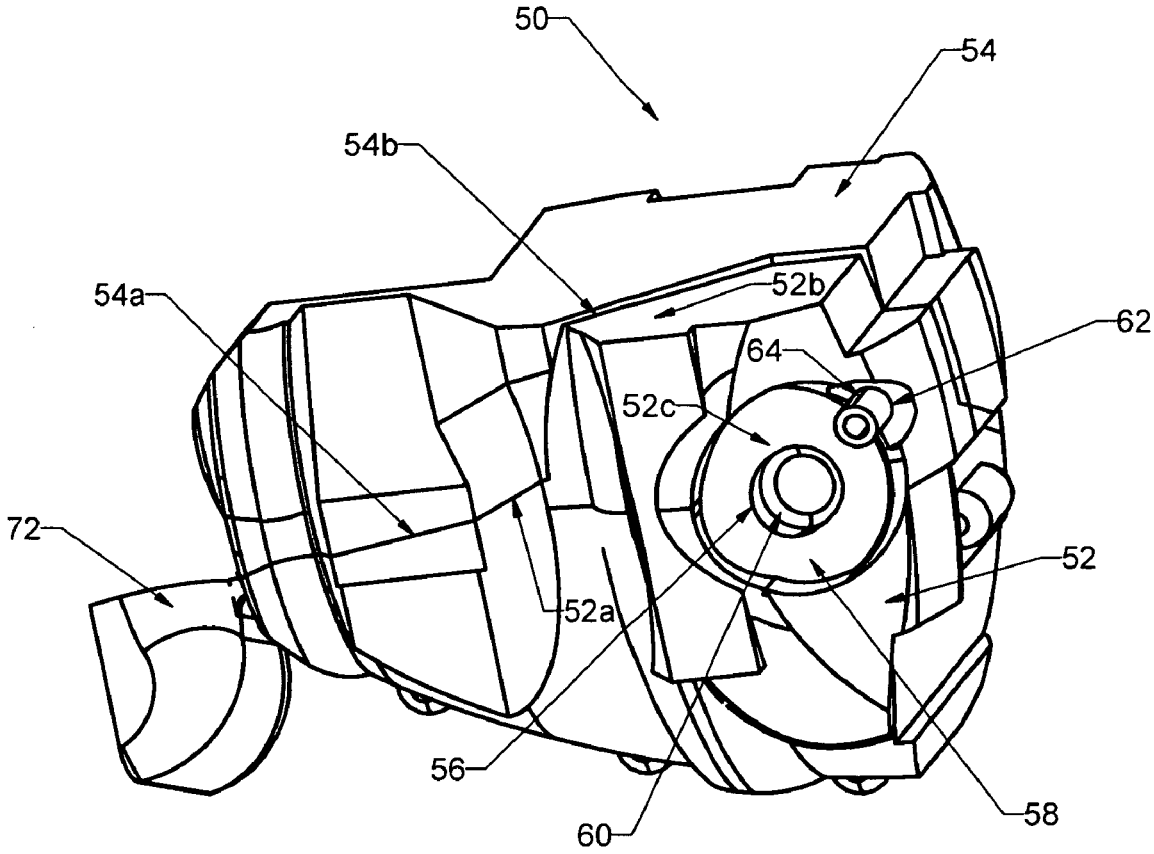
FIG. 5*a* is a front view of a boot assembly of the representative earphone.

A boot assembly or chassis 50 is positioned within an interior portion or cavity defined by housing 12 and includes a high frequency driver boot 52 and a low frequency driver boot 54. See FIGS. 5*a*-5*f*. In one form, boot assembly 50 is made from a shock absorbent or gasket like material such as an elastomer, silicone, or plastic, for example. Referring to FIG. 5*a*, a front view of boot assembly 50 is illustrated removed from housing 12. As depicted, a lower surface portion 54*a* and a side surface portion 54*b* of low frequency driver boot 54 is connected with an upper surface portion 52*a* and a side surface portion 52*b* of high frequency driver boot 52. In one form, low frequency driver boot 54 and high frequency driver boot 52 are connected to one another using any type of suitable adhesive.

A forward section 52*c* of high frequency driver boot 52 includes a first aperture or channel 56 positioned within a recessed portion 58 of high frequency driver boot 52. A spout 60 of a high frequency audio driver (discussed in detail below) protrudes outwardly a predetermined distance through first aperture 56. A second aperture or channel 62 is located in forward section 52*c* of boot assembly 50 and runs through high frequency driver boot 52 and a portion of low frequency driver boot 54. As such, high frequency driver boot 52 and low frequency driver boot 54 both include channel 62. A stainless steel tubular needle, or non-corrosive metal or rigid polymer resin tube 64 is inserted into channel 60, which is discussed in greater detail below. A portion of needle 64 protrudes outwardly a predetermined distance from high frequency driver boot 52. In one form, needle 64 is inserted into channel 62 of high frequency driver boot 52 during manufacturing prior to low frequency driver boot 54 being connected with high frequency driver boot 52.

Figure 5B:
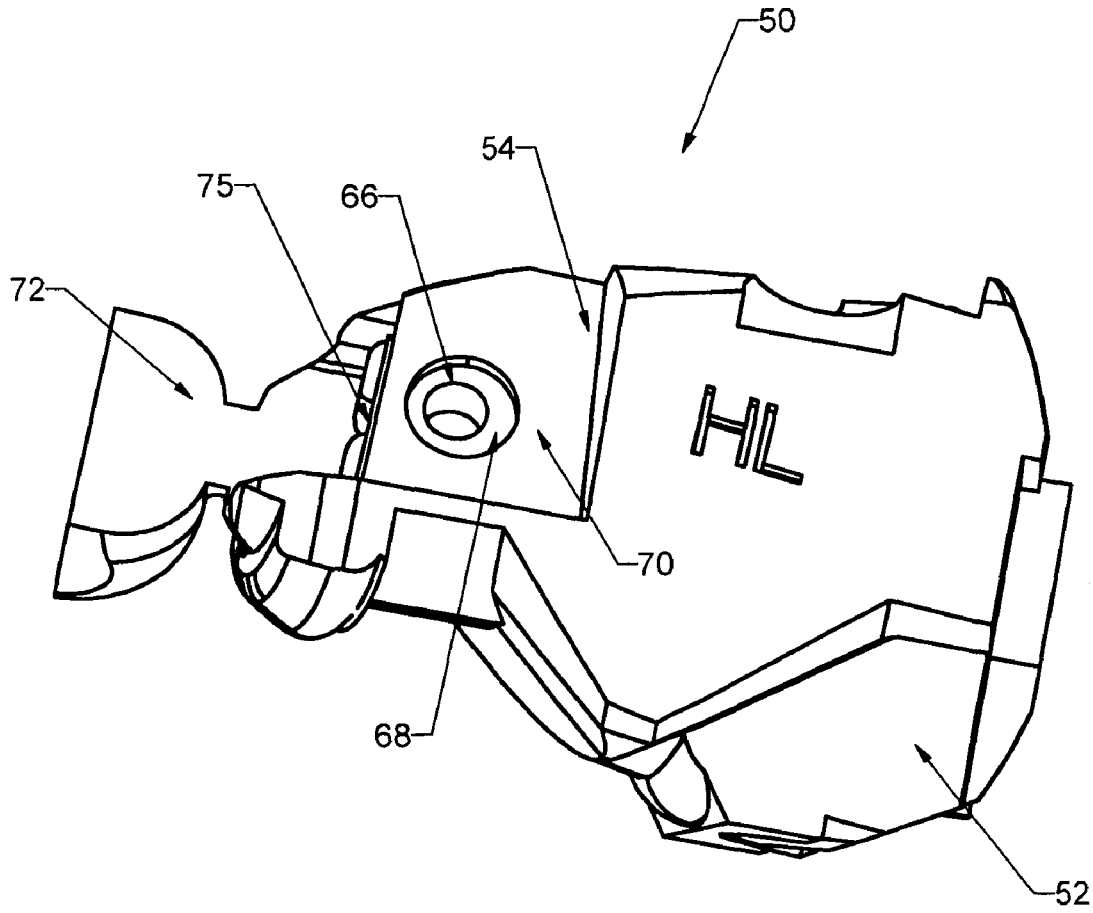
FIG. 5*b* is a top view of the boot assembly.

Referring to FIG. 5*b*, which depicts a top view of boot assembly 50, low frequency driver boot 54 includes an aperture or vent 66 located at a rearward section of low frequency driver boot 54. A vent 68 of a low frequency audio driver 70 is exposed through aperture 66 thereby exposing vent 68 to an interior portion or chamber defined by housing 12. In one form, low frequency driver boot 54 includes a flap 72 that is located on a rearward section of low frequency driver boot 54. As illustrated in FIGS. 2-4, in one form flap 72 protrudes outwardly from a flap aperture 74 in a rearward section or portion of housing 12. In another form, when earphone 10 is assembled, flap 72 flips up on a backside 75 of driver 70 to provide a concentrated force vector to the backside of driver 70. As such, when housing 12 is assembled, flap 72 is positioned inside housing 12 and applies force or pressure to backside 75 of driver 70. This concentrated force vector forces the front portion of driver 70 against a front face 110 (See FIG. 5*e*) of low frequency driver boot 54 so there is compression around snout 130 of driver 70 to prevent air leaks. Preventing air leaks around snout 130 improves bass or low frequency performance of earphone 10.

Figure 5C:
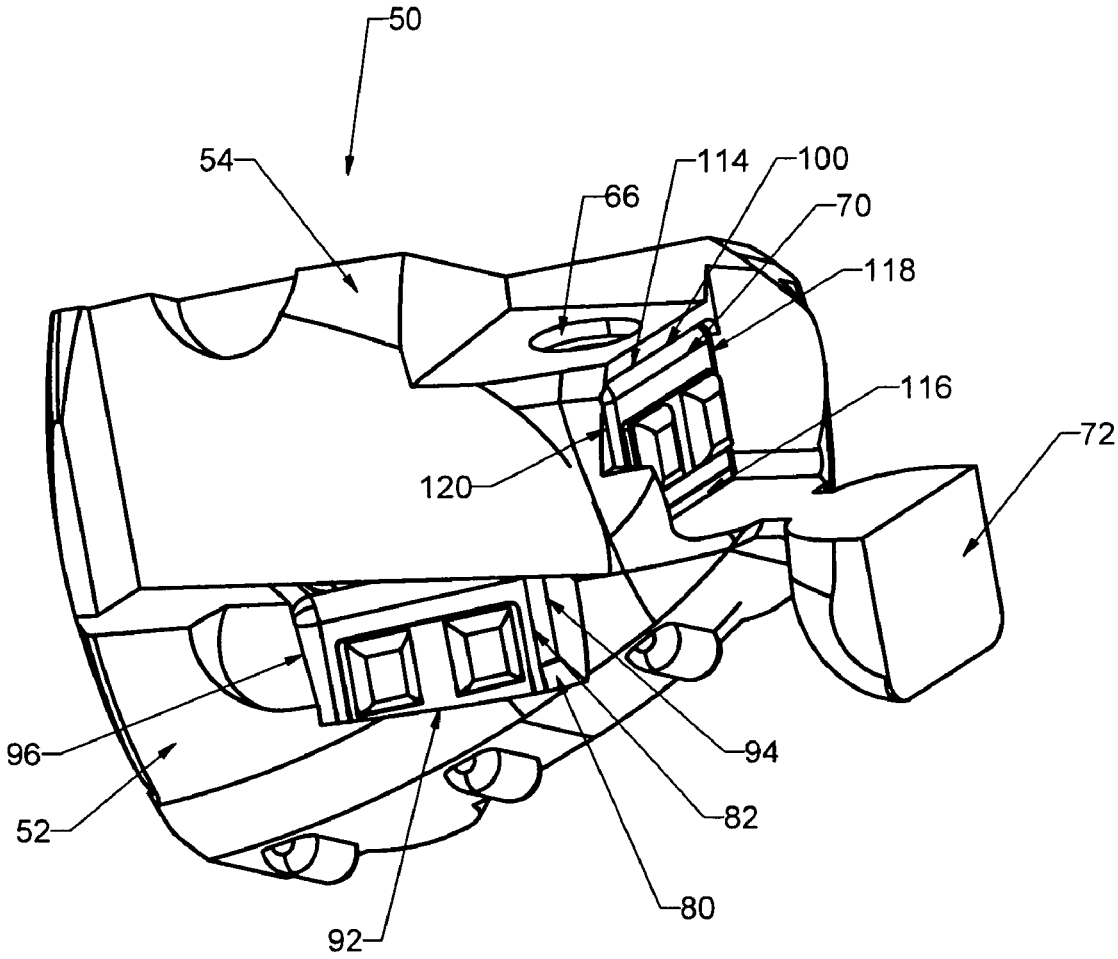
FIG. 5*c* is a rear view of the boot assembly.
Figure 5D:
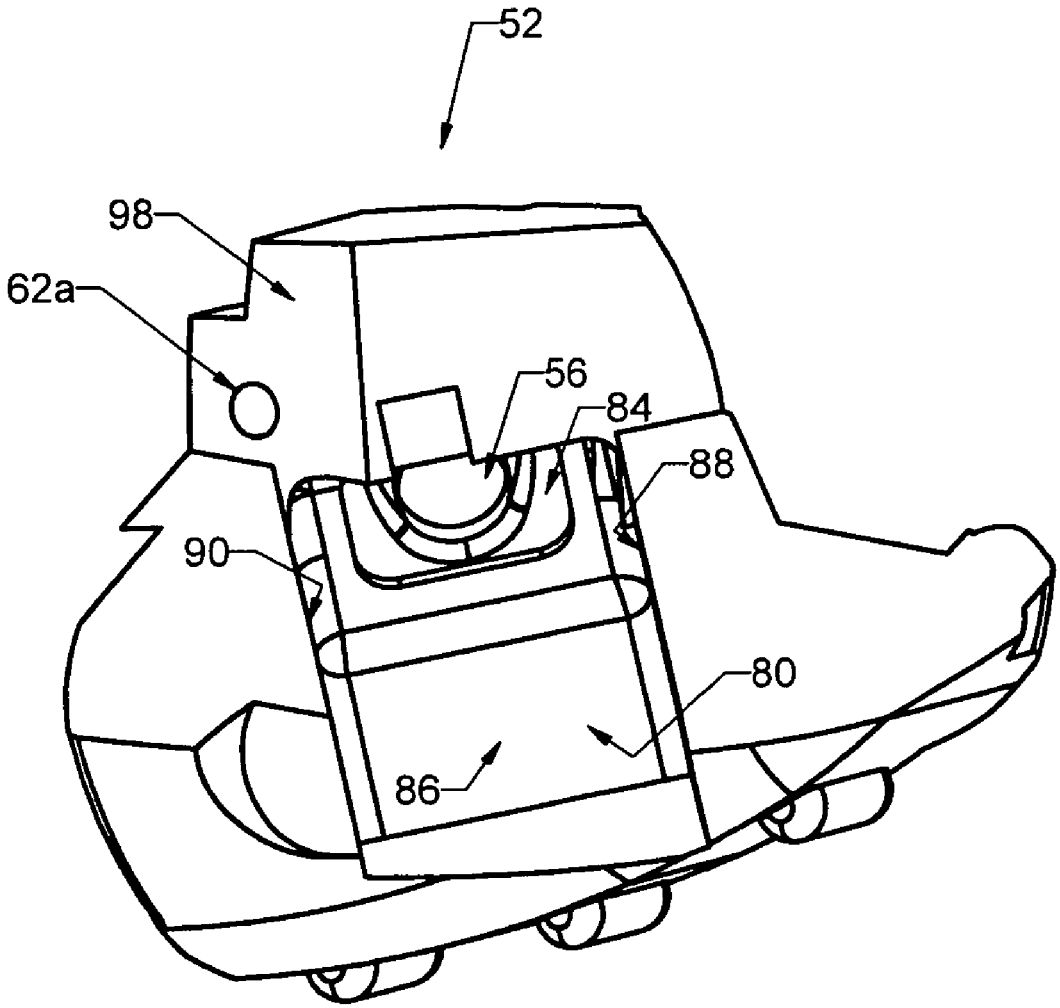
FIG. 5*d* is a rear view of a high frequency driver boot of the boot assembly.

Referring to FIGS. 5*c* and 5*d*, which depict back or rear views of boot assembly 50 and high frequency driver boot 52, high frequency driver boot 52 includes a generally U-shaped slot or passageway 80 that extends a predetermined distance into high frequency driver boot 52. As illustrated in FIG. 5*c*, a high frequency audio driver 82 is positioned in U-shaped passageway 80. Passageway 80 includes a front face 84 that includes aperture 56 from which spout 60 of driver 82 protrudes outwardly as illustrated in FIG. 5*a*.

A front portion of driver 82 is positioned against front face 84 when driver 82 is positioned in passageway 80. The front portion of driver 82 is positioned against front face 84 so that a seal is formed between the front portion of driver 82 and front face 84 to prevent air leaks. Passageway 80 includes a lower surface 86, a right-side surface 88, and a left-side surface 90. A lower portion 92, a right-side portion 94, and a left-side portion 96 of driver 80 are respectively positioned against lower surface 86, right-side surface 88, and left-side surface 90 of high frequency driver boot 52. As best illustrated in FIG. 5*d*, a rearward portion of channel 62*a*, in which needle 64 is inserted, is located on a side surface 98 of high frequency driver boot 52.

Figure 5E:
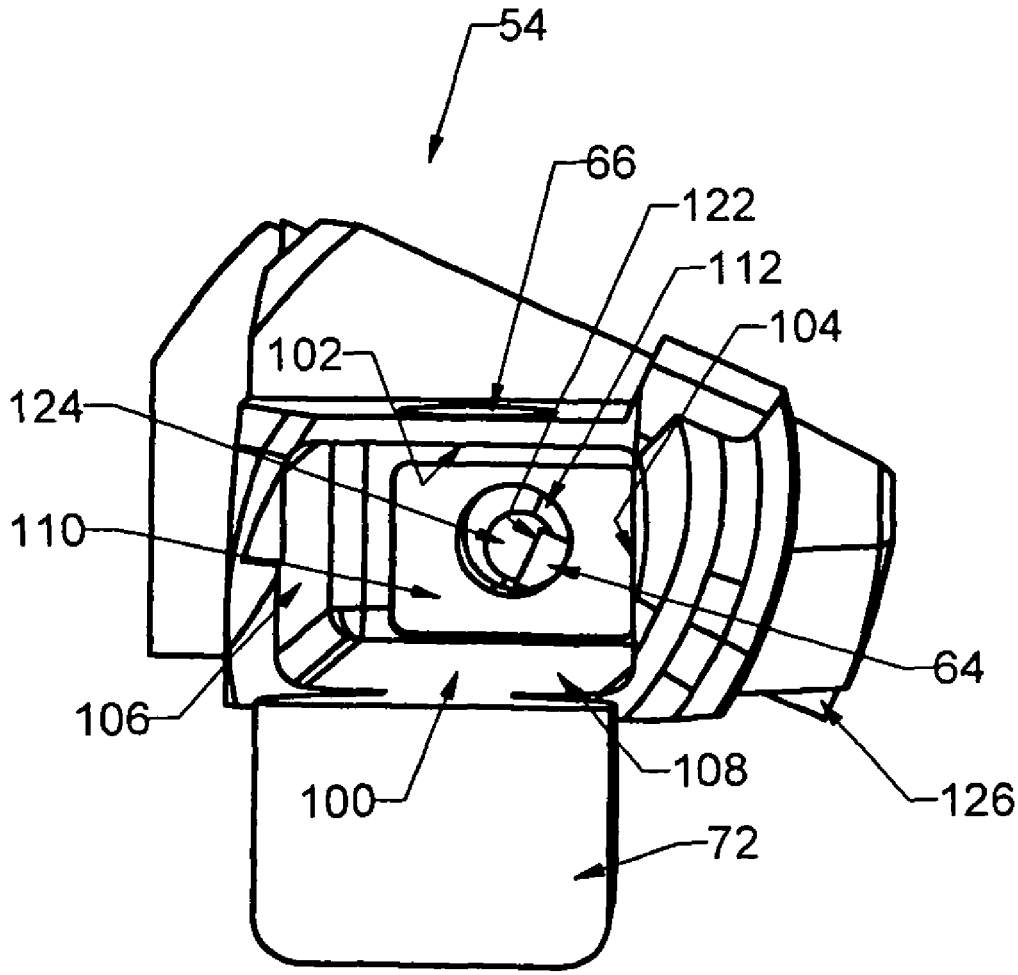
FIG. 5*e* is a side view of a low frequency driver boot of the boot assembly.

As further illustrated in FIG. 5*c*, low frequency driver boot 54 includes a generally rectangular shaped slot or passageway 100 that extends a predetermined distance into low frequency driver boot 54. Driver 70 is positioned inside or within passageway 100. Referring to FIG. 5*e*, which illustrates a left-side view of low frequency driver boot 54 with driver 70 removed, passageway 100 includes an upper surface 102, a right-side surface 104, a left-side surface 106, a lower surface 108, and a front surface or face 110. Front face 110 includes an aperture 112 through which, although not illustrated in this view, a spout 130 of driver 70 protrudes outwardly. A front portion of driver 70 is positioned against front face 110 such that a seal is formed between the two respective elements.

Figure 5F:
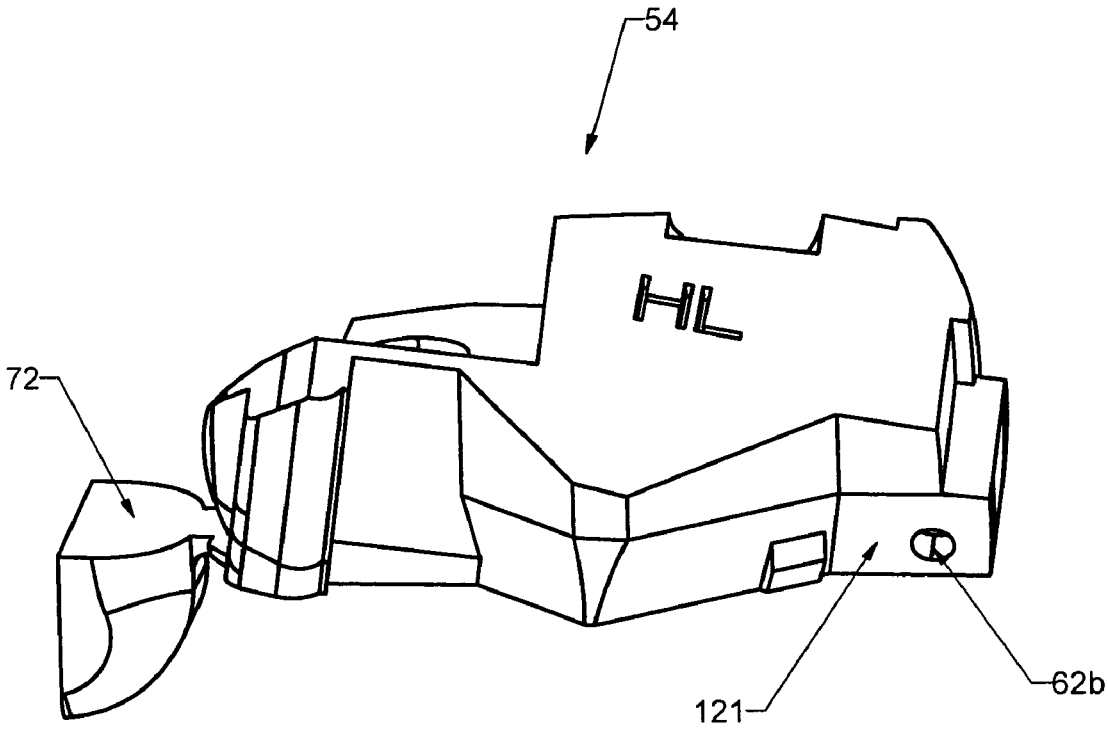
FIG. 5*f* is a top perspective view illustrating the front of the low frequency driver boot.

An upper portion 114, a lower portion 116, a right-side portion 118, and a left-side portion 120 of driver 70 are respectively positioned against upper surface 102, lower surface 108, right-side surface 104, and left-side surface 106 of low frequency driver boot 54. Referring to FIGS. 5*e* and 5*f*, a front portion 121 of low frequency driver boot 54 includes a channel or aperture 62*b* through which needle 64 is inserted. A first end 122 of needle 64 protrudes into a chamber 124 formed in an interior portion of low frequency driver boot 54.

Figure 6:
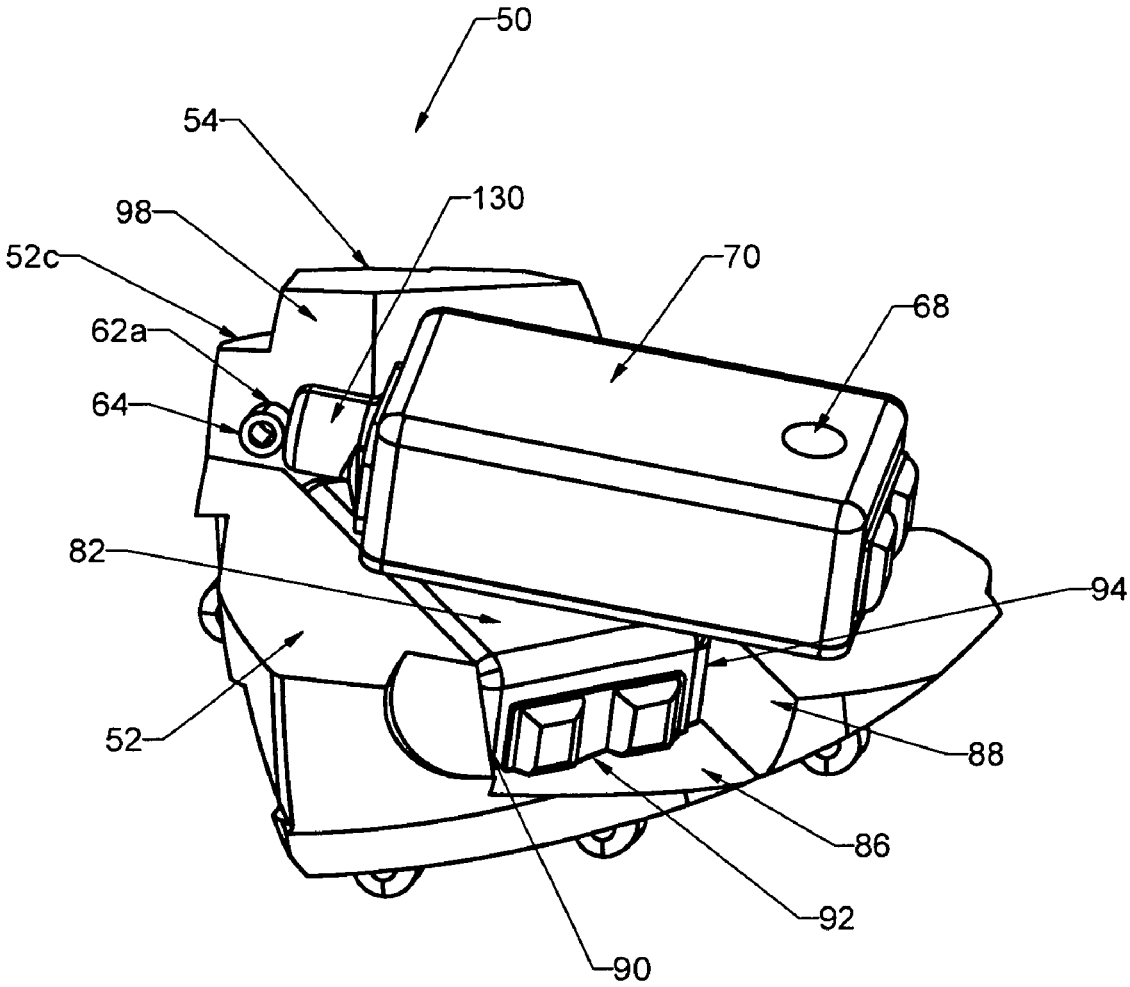
FIG. 6 is a rear perspective view illustrating the orientation of drivers of the earphone in relation to the high frequency driver boot.

As set forth in greater detail below, spout 130 of driver 70 also protrudes into chamber 124. See FIG. 8. A second end 126 of needle 64 extends outwardly from low frequency driver boot 54 and needle 64 is positioned within channel 62 of high frequency driver boot 52. See FIGS. 3-4. As illustrated in FIG. 5*f*, front portion 121 of low frequency driver boot 54 includes channel 62*b*. As illustrated in FIG. 6, front portion 52*c* of high frequency driver boot 54 includes channel 62*a*. Channels 62*a* and 62*b* are aligned with one another and form a unitary channel 62 through high frequency driver boot 52 and low frequency driver boot 54 when boots 52, 54 are connected or aligned together.

Referring to FIG. 6, a rear view of boot assembly 50 is illustrated with low frequency driver boot 54 removed or disconnected from high frequency driver boot 52. As previously set forth, low frequency driver 70 includes a spout 130 that protrudes outwardly from a forward end of driver 70. As set forth previously with, respect to FIG. 5*e*, spout 130 protrudes into audio chamber 124 of low frequency driver boot 54. See FIG. 8. In this form, spout 130 is aligned generally perpendicular in relation to needle 64 in chamber 124, but spout 130 and needle 64 are not connected to one another in chamber 124. As such, chamber 124 forms an air chamber or acoustic path between spout 130 and first end 122 of needle 64. In other representative forms, spout 130 and needle 64 may be aligned at other respective angles relative to one another and not necessarily in a generally perpendicular relationship.

Figure 7:
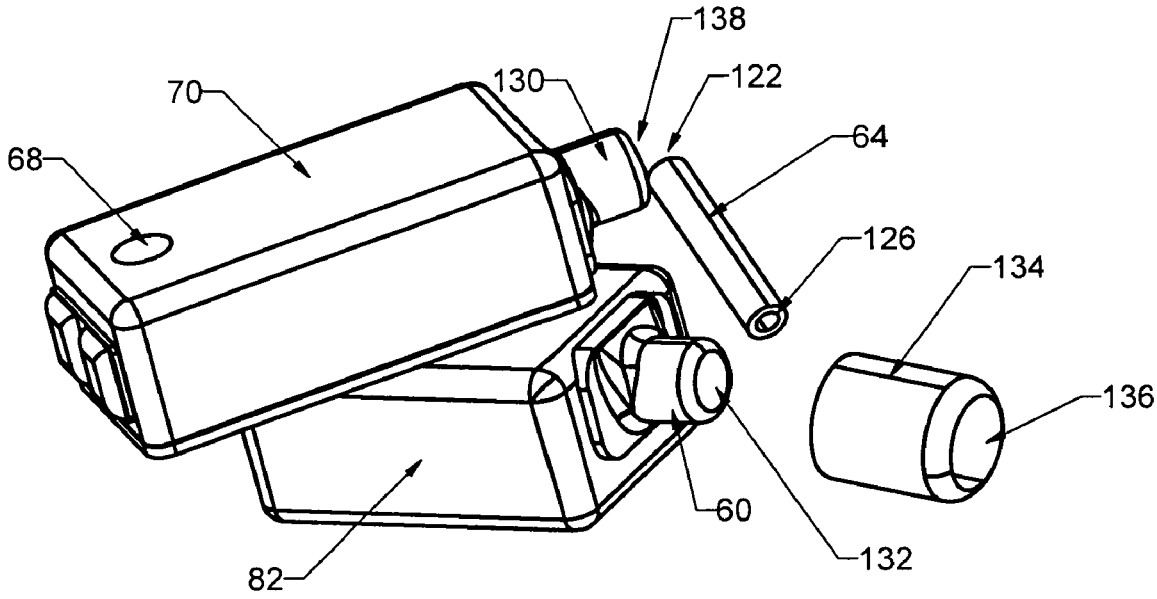
FIG. 7 is a perspective view of the drivers, a needle, and an acoustic damper of the earphone.

Referring to FIG. 7, an illustrative view of the arrangement of drivers 70, 82 and needle 64 with high frequency driver boot 52 and low frequency driver boot 54 removed is illustrated. As illustrated, in this form an output port 132 of spout 60 of high frequency driver 82 is positioned in relative alignment with a generally cylindrical shaped acoustic damper 134 that is positioned within nozzle housing 14. Acoustic damper 134 includes a cylindrical bore or passageway 136 that runs through the entire width or length of acoustic damper 134. Acoustic damper 134 is configured as an acoustic resistor to absorb the reactive components of the audio output or tuned to effectively control the rate at which sound energy is dissipated as it exits spout 60 and needle 64 before traveling to nozzle 28 and out port 24 of ear tip 16. In one form, acoustic damper 134 is configured to reduce the high Q resonance of frequency response generally in the mid to high frequency range of the sound spectrum.

Spout 130 of low frequency driver 70 is offset from spout 60 of high frequency driver 82 at approximately a 45° angle. Other configurations are envisioned and unless otherwise claimed, the specific arrangement of drivers 70, 82 should not be construed as a limitation of the present invention. First end 122 of needle 64 is aligned generally perpendicular to an output 138 of driver 70 and second end 126 is oriented in the general direction of acoustic damper 134. During operation, acoustic energy or sound produced by high frequency driver 82 is directed toward acoustic damper 134. Acoustic energy produced by low frequency driver 70 is directed into chamber 124, which in turn, enters first end 122 of needle 64, passes through needle 64 and is directed out second end 126 to acoustic damper 134.

Figure 8:
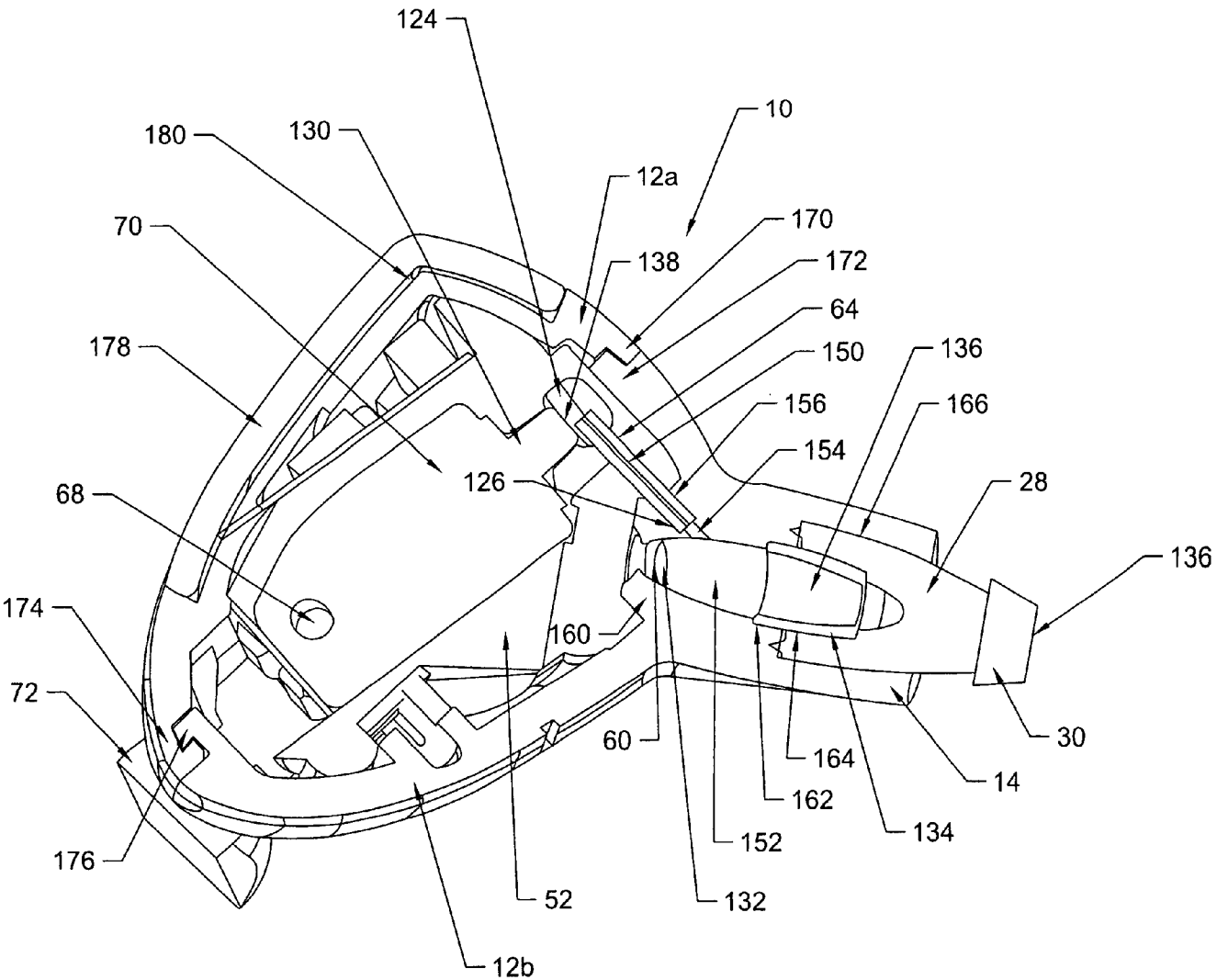
FIG. 8 is a cross-sectional view of the earphone illustrating acoustic routing ports of the earphone.

As illustrated in FIG. 8, which depicts a cross-sectional view of a portion of earphone 10, spout 130 of low frequency driver 70 protrudes outwardly from low frequency driver boot 54 a predetermined distance into chamber 124. Needle 64 protrudes into chamber 124 a predetermined distance and includes an aperture or bore 150 running through the entire length or interior portion of needle 64 for transmitting acoustic energy to an acoustic combining or summation chamber 152 formed in housing 12. In one form, rear housing 12*b* includes a needle port or aperture 154 and a portion of needle 64 that protrudes outwardly from high frequency driver boot 52 is secured or positioned within access port 156. Access port 156 transitions into needle port 154 in rear housing 12*b*, which has an opening into acoustic combining chamber 152. Spout 60 of high frequency driver 82 protrudes into acoustic combining chamber 152, which mixes the audio signals produced by drivers 70, 82 before being channeled or directed to acoustic damper 134.

In one form, nozzle housing 14 includes a generally circular shaped internal rib 160 that rests against or is connected with circular recess 58 in high frequency driver boot 52. See FIG. 3. An internal surface of acoustic combining chamber 152 is connected with or surrounds spout 60 of driver 82. As such, combining chamber 152 is in acoustic communication with the output of low frequency driver 80 and the second end 126 of needle 64. In this form, access port 156 and input port 154 are also located in a portion of internal rib 160. As further illustrated, a lower portion of acoustic damper 134 is positioned within an internal recess 162 of nozzle housing 14. An upper portion of acoustic damper 134 is positioned within a nozzle recess 164 of nozzle 28. A portion of nozzle 28 is positioned within a nozzle recess 166 of nozzle housing 14.

An external lip 170 of front housing 12*a* is connected with an internal lip 172 of rear housing 12*b*. A first interlocking member 174 of front housing 12*a* is connected with a second interlocking member 176 of rear housing 12*b*. As such, as depicted in FIG. 1, rear and front housings 12*a*, 12*b* snap together to form unitary housing 12. A decorative member 178 (e.g.,—trademark emblem) is connected with an outside surface 180 of front housing 12*a* by a friction fit or an adhesive.

Figure 9:
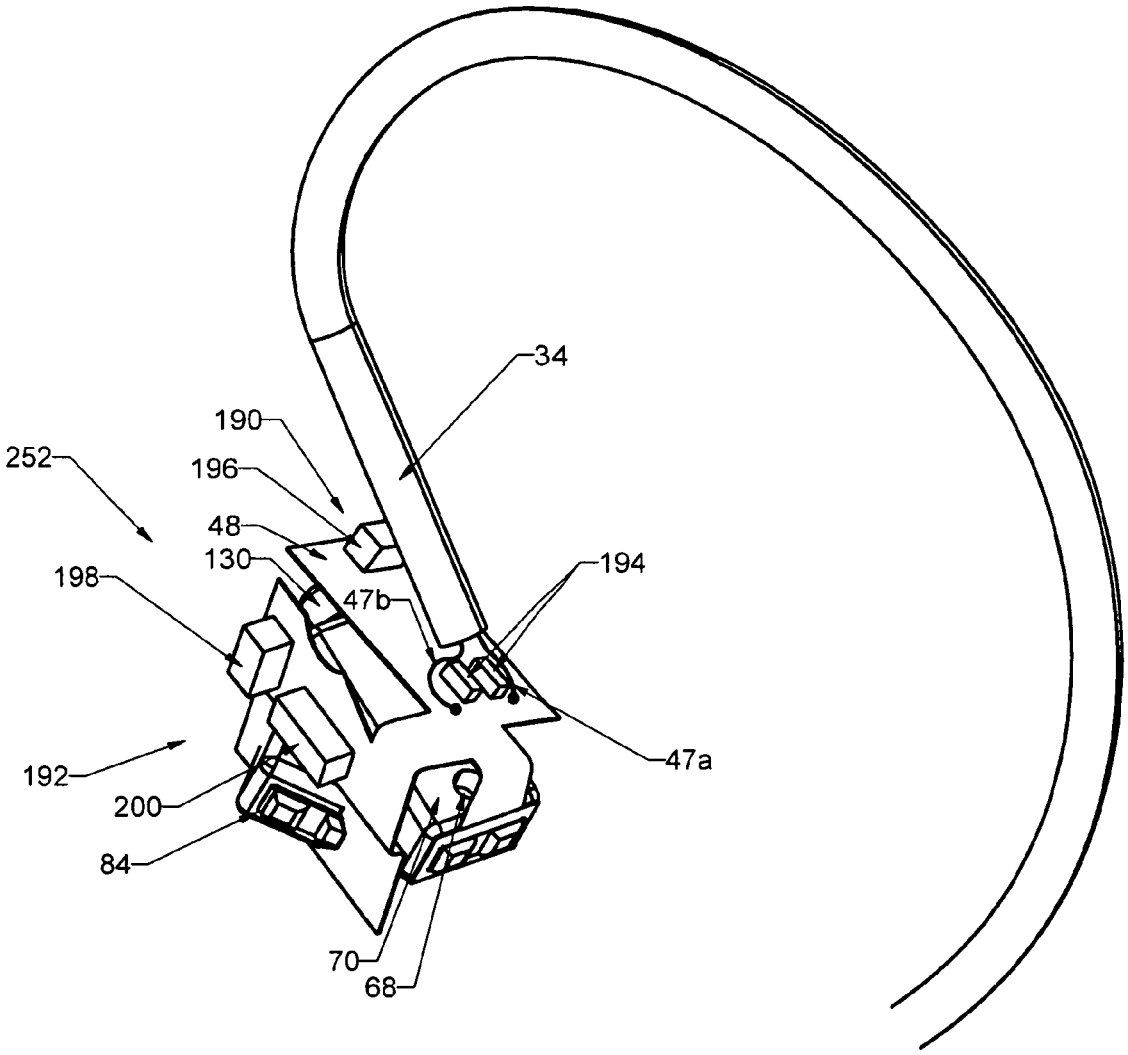
FIG. 9 is a perspective view of a portion of the earphone illustrating the electrical hardware of the earphone.

Referring to FIG. 9, as previously set forth, audio cable 34 includes at least two audio wires 47*a*, 47*b* that are connected with flexible circuit board 48. In one form, the audio signals supplied by wires 47*a*, 47*b* are supplied to a low order electronic crossover 252. See FIG. 10. Low order electronic crossover 252 includes a low pass crossover 190 and a high pass crossover 192. A first audio signal is supplied to low pass crossover 190 and a second audio signal is supplied to high pass crossover 192. In one form, low pass crossover 190 includes a pair of resistors 194 and a capacitor 196 and high pass crossover 192 includes a resistor 198 and a capacitor 200. Low pass crossover 190 is configured to pass frequencies falling within a predetermined low frequency range and filter out or block frequencies falling outside the predetermined low frequency range. High pass crossover 192 is configured to pass frequencies falling within a predetermined high frequency range and filter out or block frequencies falling outside the predetermined high frequency range.

Flexible circuit board 48 is connected with low frequency driver 70 and high frequency driver 82. In particular, an analog audio output signal of low pass crossover 190 is supplied to low frequency driver 70 and a second analog output signal of high pass crossover 192 is supplied to high frequency driver 82. In one form, low frequency driver 70 comprises a balanced armature receiver supplied by Klipsch, LLC as receiver model number KG731. High frequency driver 82 comprises a balanced armature receiver supplied by Klipsch, LLC as receiver model number KG732. In other forms, other types of drivers capable of reproducing acoustic energy or sound may be utilized.

Referring back to FIG. 8, in one form bore or passageway 150 of needle 64 has an inside diameter of about 0.33 millimeters (0.013 inches) and needle 64 has an outside diameter of about 0.7 millimeters (0.026 inches). In addition, the length of needle 64 is approximately 4-4.5 millimeters (0.1575-0.1772 inches), but different lengths may be utilized in alternative forms. Needle 64 may have other inside diameters, outside diameters and lengths, but this inside diameter allows earphone 10 to be configured to have a crossover point around 1.0-1.5 kHz. Due to the small size of earphone 10, known prior earphone designs were only capable of having crossover points configured at about 4 kHz. Lowering the crossover point together with providing at least two drivers allows earphones 10 to provide optimum audio reproduction. In particular, bass frequencies, in this case frequencies falling below about 1.0-1.5 kHz are capable of optimally being reproduced by low frequency driver 70 and frequencies above 1.0-1.5 kHz are capable of optimally being reproduced by high frequency driver 82. A tunable cutoff frequency is capable of being provided by varying the length of needle 64.

Figure 10:
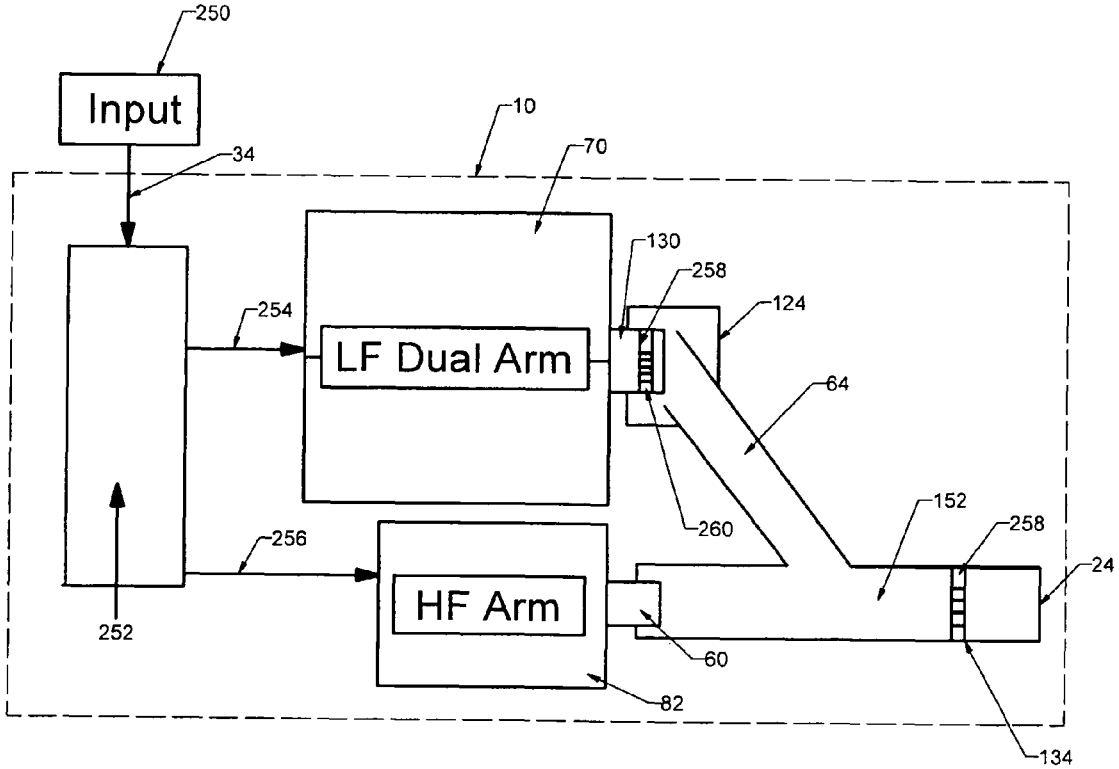
FIG. 10 is a block diagram illustrating various aspects of the earphone.

Referring to FIG. 10, a block diagram is depicted that illustrates earphone 10 in a more simplified block diagram format. As illustrated, audio cable 34 is connected with an audio source 250. In this form, a low order electronic crossover 252 is included in earphone 10. As previously set forth, low order electronic crossover 252 is configured to generate two audio output signals. A first audio output signal 254 is supplied to low frequency driver 70 and a second audio output signal 256 is supplied to high frequency driver 82.

In one form, low frequency audio driver 70 comprises a dual balanced armature such as the one disclosed in U.S. patent application Ser. No. 11/897,380 filed Aug. 30, 2007 and entitled "Balanced Armature with Acoustic Low Pass Filter", which is hereby incorporated by reference in its entirety. In an alternative form, low frequency audio driver 70 comprises a dual balanced armature that has a grid filter 258 located in spout 130. In this arrangement, grid filter 258 includes a plurality of apertures or holes 260 that are configured to act as low pass filtering elements. In yet another form, acoustic damper 134 includes a grid filter 258 that is configured and operable to remove unwanted acoustic sounds.

As illustrated, the audio output of low frequency driver 70 is directed into chamber 124. Tube 64 is positioned in chamber 124 and extends into combining chamber 152. As set forth above, tube 64 acts as a tuned low pass filter. High frequency driver 82 includes a snout 60 that is positioned in combining chamber 152. As such, the audio output of high frequency driver 82 is supplied to combining chamber 152. Combining chamber 152 combines the audio outputs supplied by tube 64 and high frequency driver 82 into an output that is directed to acoustic damper 134. Acoustic damper 134 also acts as a filter to remove undesirable audio signals. As such, low order electronic crossover 252, grid filter 258, tube 64, and damper 134 create a 4th order low pass filter (i.e.—four separate filters) in earphone 10.

Figure 11:
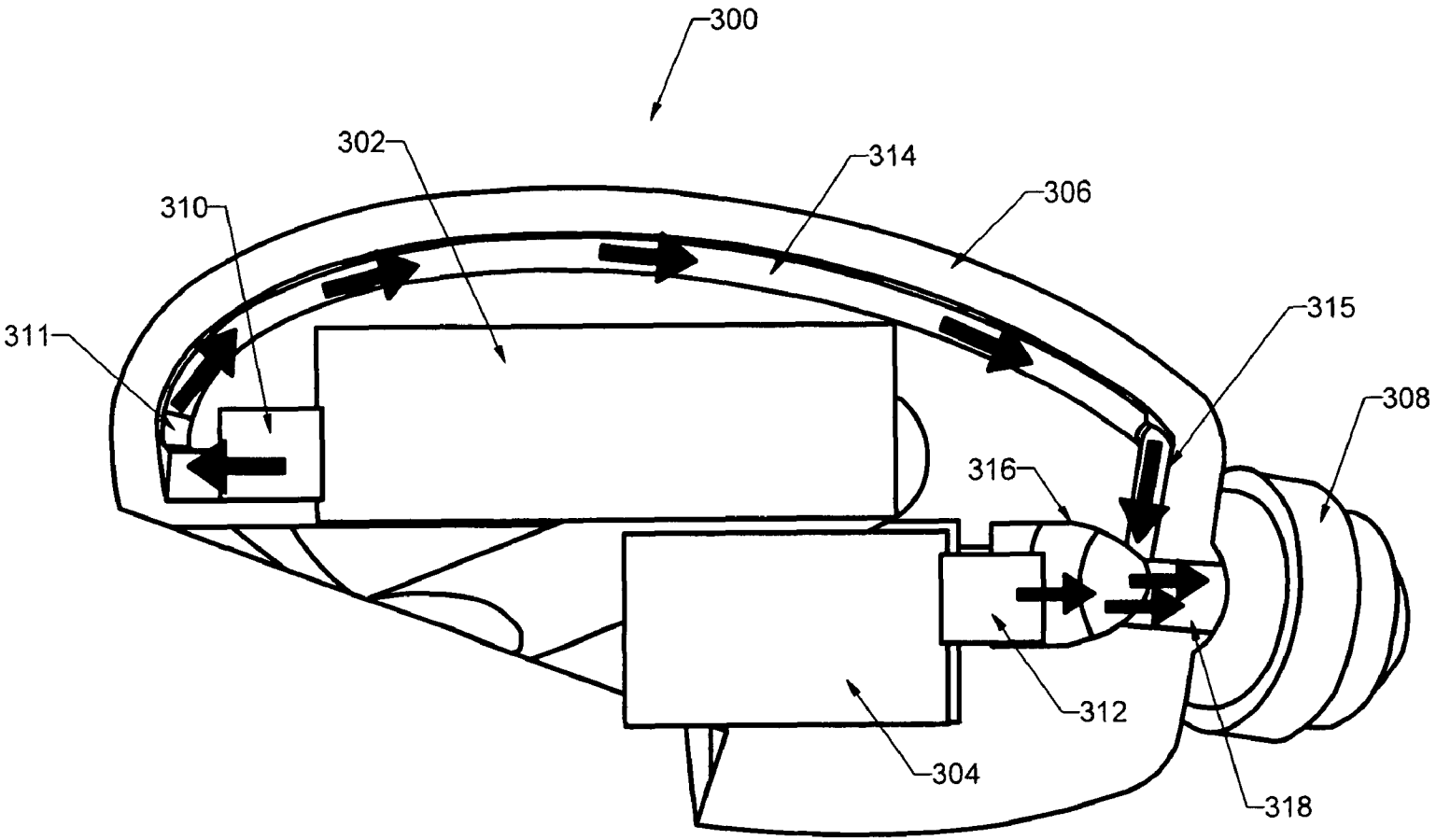
FIG. 11 illustrates another representative earphone.

Referring to FIG. 11, yet another form of the present invention discloses an earphone 300 that includes a low frequency audio driver 302 and a high frequency audio driver 304 positioned in a boot assembly or housing 306. A nozzle 308 is connected with boot assembly 306 and acts as an acoustic exit in a manner substantially the same as previously set forth. As illustrated, low frequency audio driver 302 and high frequency audio driver 304 are positioned in a generally inverted relationship to one another. In particular, a spout or acoustic output 310 of low frequency audio driver 302 is positioned generally 180° or the opposite way of a spout or acoustic output 312 of high frequency audio driver 304.

As illustrated, spout 310 is connected with a first end 311 of an acoustic passageway 314 that travels back across the body of low frequency driver 302 in an arced path until a second end 315 of acoustic passageway 314 enters an acoustic combining or summation chamber 316. Spout 312 of high frequency audio driver 304 is positioned in combining chamber 316. As such, the acoustic outputs of audio drivers 302, 304 are both channeled or directed to combining chamber 316 which forms a unitary acoustic output that is supplied or directed to nozzle 308. The inverted orientation of the audio output or spout 310 of low frequency audio driver 302 in relation to the audio output or spout 312 of high frequency audio driver 304 allows the low frequency audio driver 302 to acoustically roll off unwanted high audio frequencies. The audio outputs from drivers 302, 304 mix in combining chamber 316. The mixed audio output is then directed down a small channel 318 before entering nozzle 308 and exiting through ear tip 16 through output port 24. See FIG. 1.

Figure 12:
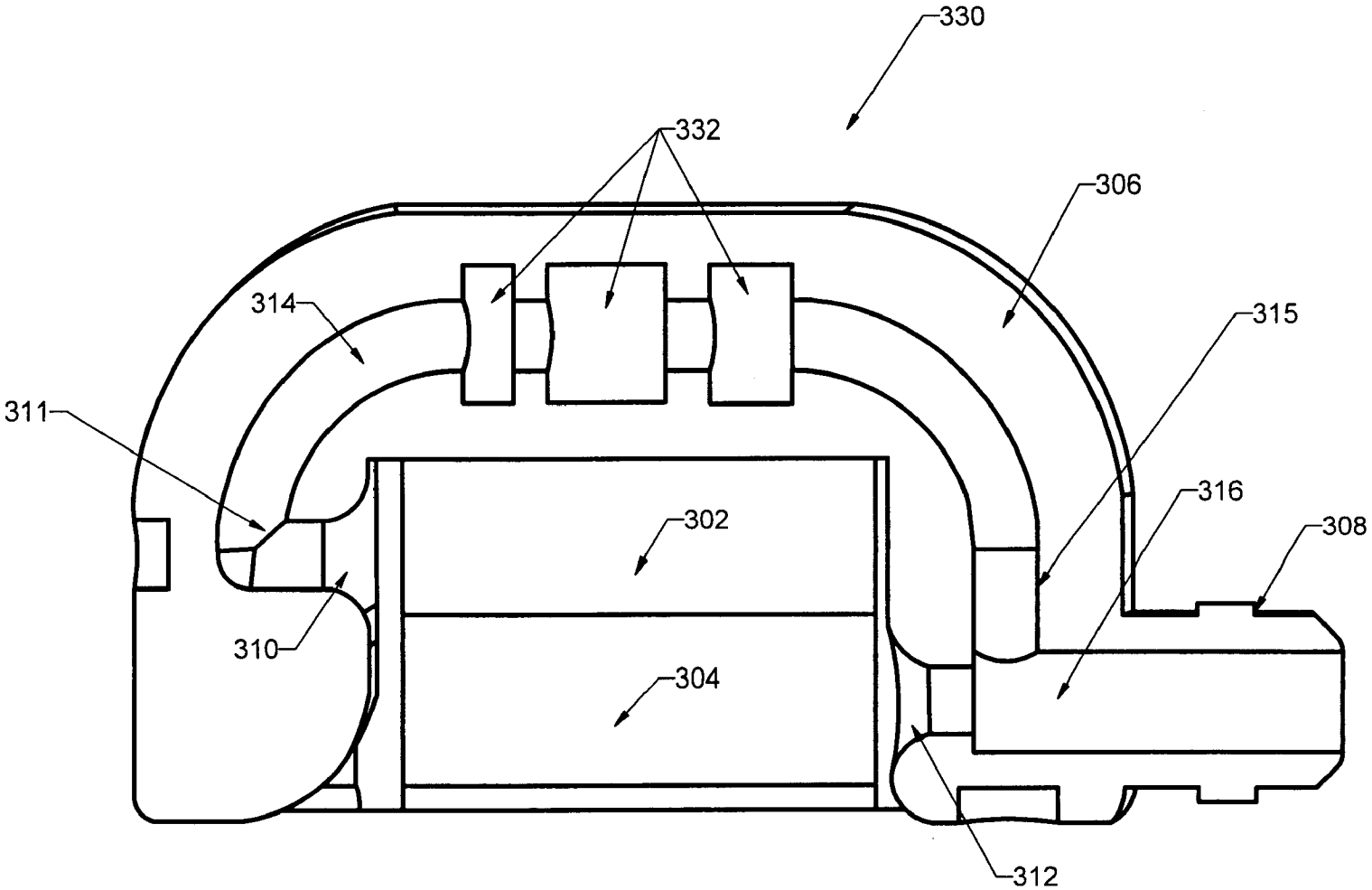
FIG. 12 illustrates another representative earphone including at least one cylinder in an acoustic channel.

Referring to FIG. 12, a portion of another representative earphone 330 is illustrated that includes a plurality of cylinders or mufflers 332 located in acoustic passageway or channel 314 that is connected with the audio output or spout 310 of low frequency audio driver 302. Cylinders 332 have varying volumes that are tailored or designed to filter out or attenuate frequencies above a predetermined threshold of frequencies. In one form, cylinders 332 are formed to attenuate or filter out frequencies falling above approximately 1.0-1.5 kHz. As illustrated, cylinders 332 may have different widths or lengths as well as varying heights in alternative forms. Varying the lengths, widths and heights of cylinders 332 changes the volume associated with cylinders 332 thereby allowing the fine tuning of the range of frequencies attenuated by cylinders 332.

Figure 13:
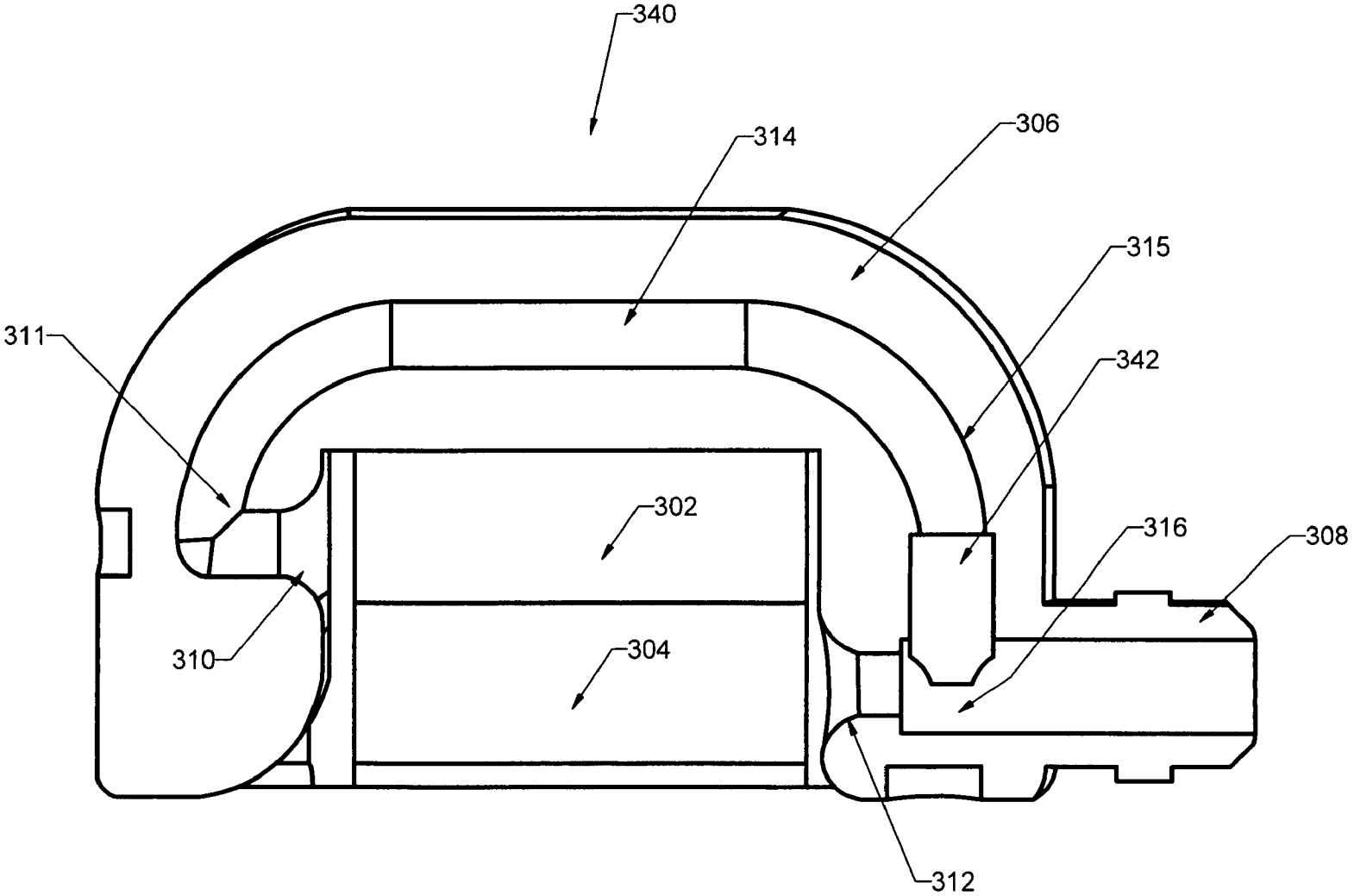
FIG. 13 illustrates another representative earphone including an acoustic damper in an acoustic channel.

Referring to FIG. 13, yet another portion of a representative earphone 340 is illustrated in which an acoustic damper 342 is positioned in acoustic passageway 314 that is connected with the output or spout 310 of low frequency driver 302. Acoustic damper 342 is designed and configured to attenuate frequencies falling above a predetermined threshold of frequencies. In one form, acoustic damper 342 is designed and configured to attenuate or filter out frequencies falling above approximately 1.0-1.5 kHz.

Figure 14:
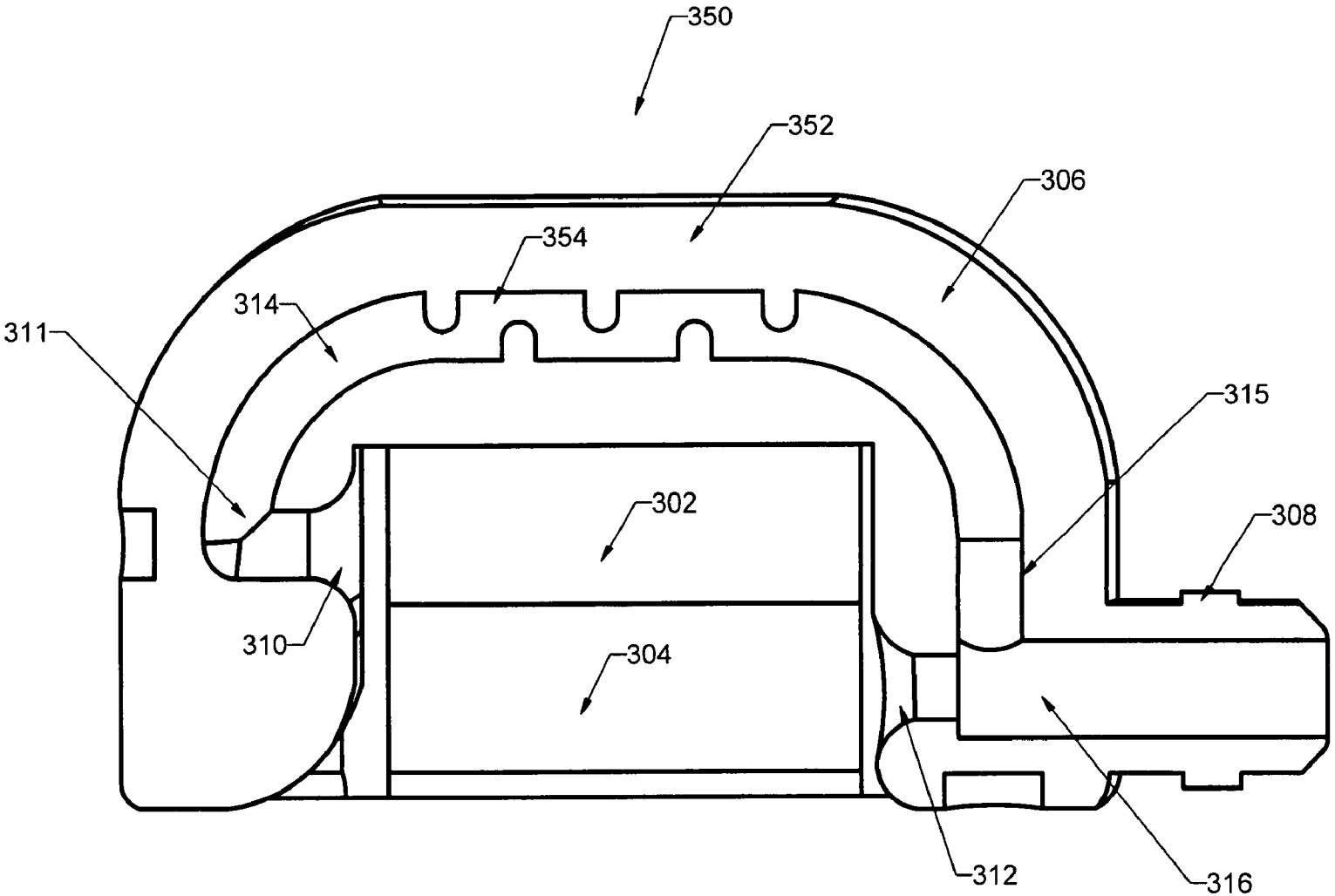
FIG. 14 illustrates another representative earphone including at least one baffle in an acoustic channel.

In FIG. 14, another representative form of an earphone 350 is illustrated that includes a baffle segment 352 located in passageway 314 that is connected with the output 310 of low frequency driver 302. Baffle segment 352 includes at least one alternating flow path 354 that deflects or regulates the flow of sound through baffle segment 352. In one form, baffle segment 352 is configured to attenuate or filter out frequencies falling above approximately 1.0-1.5 kHz. Other frequency settings or ranges can be utilized in alternative configurations.

Figure 15:
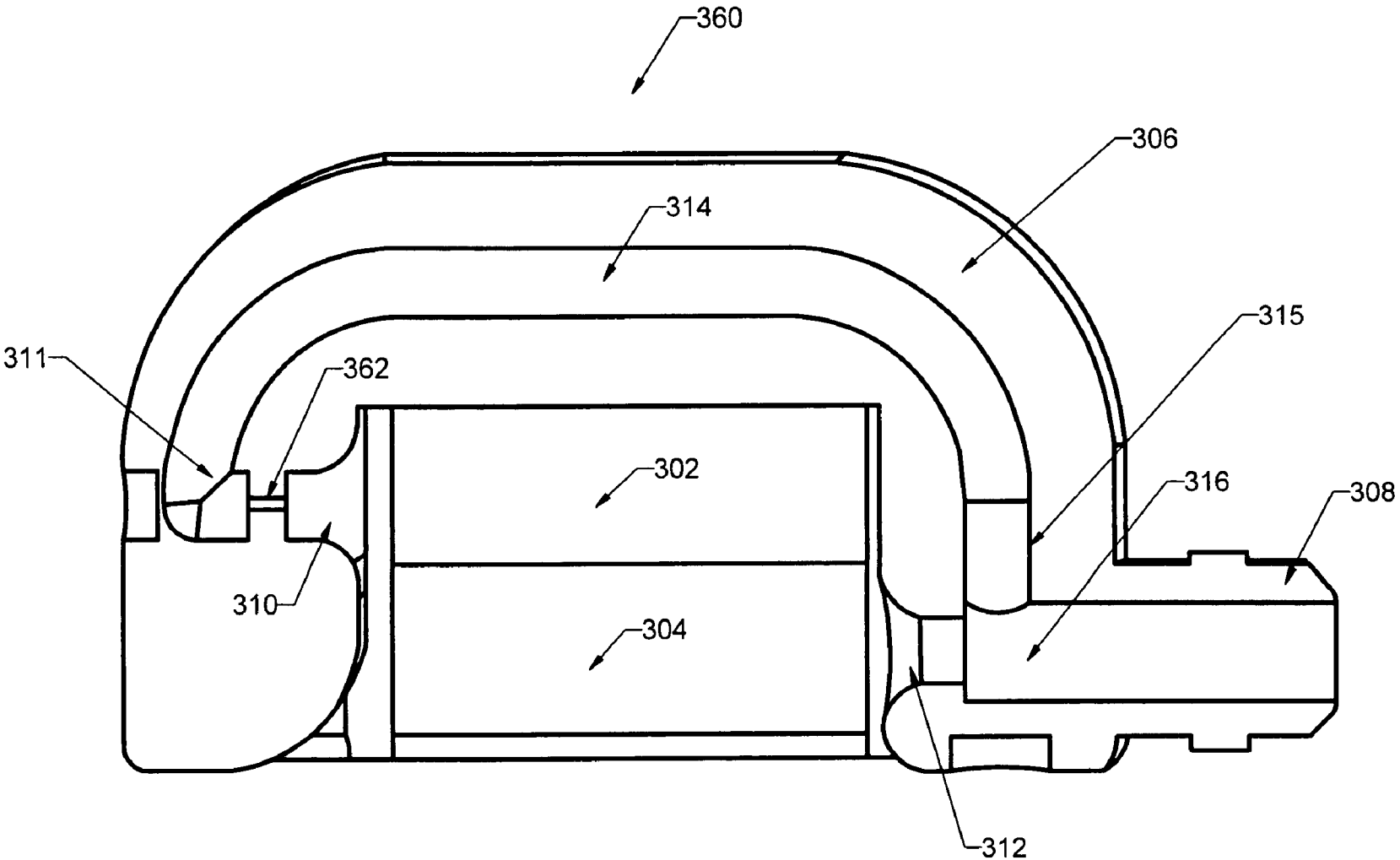
FIG. 15 illustrates another representative earphone including a constriction member in an acoustic channel.

Referring to FIG. 15, in yet another representative form, an earphone 360 is illustrated that includes a constriction segment 362 located in passageway 314 that is connected with output 310 of low frequency audio driver 302. In one form, constriction segment 362 comprises a tubular channel in housing or boot assembly 306 that has a predetermined diameter and a predetermined length. In one form, the predetermined diameter and length is configured and designed to attenuate or filter out frequencies falling above approximately 1.0-1.5 kHz. In another form, constriction segment 362 comprises a tube inserted into boot assembly 306 as previously discussed.

The earphone 10 described above includes an electro-acoustic crossover. Because of the use of tube 64, the acoustic low pass element in earphone 10, a lower crossover point is achieved with a sharper roll off than with conventional earphone designs. Tube 64, as an acoustic element, possesses a resistive and reactive impedance. The resistive and reactive acoustic impedance of the tube 64 is what allows this lower crossover point and sharp roll off. The resistance is due to boundary layer surface friction in tube 64. The reactance is due to the air mass contained within tube 64. As tube 64 gets smaller, the restive component of the impedance begins to dominate.

As set forth above, in one form, an apparatus is disclosed that comprises: a chassis defining a chamber and a combining chamber; a first audio driver positioned in at least a portion of the chassis, the first audio driver having a first output in audio communication with the chamber; a tube having a first end in audio communication with the chamber and a second end in audio communication with the combining chamber; and a second audio driver positioned in at least a portion of the chassis, the second audio driver having a second output in audio communication with the combining chamber.

In yet another form, an apparatus is disclosed that comprises: a first audio driver having a first output in audio communication with a chamber; a tube having a first end in audio communication with the chamber and a second end in audio communication with a combining chamber; and a second audio driver having a second output in audio communication with the combining chamber.

In another form, a method of manufacturing an audio device for an ear is disclosed comprising: arranging a first audio driver such that a first audio output is in audio communication with a chamber; placing a tube in audio communication with the chamber and a combining chamber; and arranging a second audio driver such that a second audio output is in audio communication with the combining chamber.

In yet another form, an audio device for an ear is disclosed comprising: a first audio driver positioned in a body in a first orientation having a first output positioned in an acoustic channel; and a combining chamber connected with an end of the acoustic channel; and a second audio driver positioned in the body in a second orientation in relation to the first audio driver having a second output connected with the combining chamber.

In a further form, an earphone is disclosed comprising: a housing; a boot assembly positioned in the housing; a first audio driver positioned in the boot assembly such that a first output of the first audio driver is in audio communication with a chamber in the boot assembly; a second audio driver positioned in the boot assembly such that a second output of the second audio driver is in audio communication with a combining chamber in the boot assembly; and a tube positioned in the boot assembly having a first end in audio communication with the chamber and a second end in audio communication with the combining chamber.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. An apparatus, comprising:

a chassis comprising a first boot connected with a second boot, wherein said first boot defines an audio chamber;

a first audio driver positioned in said first boot, said first audio driver having a first output port positioned in said audio chamber;

a tube having a first end positioned in said audio chamber and a second end positioned in a combining chamber, where said tube is positioned generally perpendicular in relation to said first output port;

a second audio driver positioned in said second boot, said second audio driver having a second output port positioned in said combining chamber; and an acoustic damper in audio communication with said combining chamber.

2. The apparatus of claim 1, where said tube extends through a first aperture in said first boot to said audio chamber and a second aperture in said second boot such that said second end is in audio communication with said combining chamber.

3. The apparatus of claim 1, where said first and second boots comprise a shock absorbent material.

4. The apparatus of claim 1, where at least a portion of said acoustic damper is positioned in a nozzle.

5. The apparatus of claim 4, further comprising an ear bud connected with an end of said nozzle.

6. The apparatus of claim 1, where said tube includes an acoustic passageway running through said tube.

7. The apparatus of claim 6, where said acoustic passageway has a diameter of about 0.33 millimeters.

8. The apparatus of claim 7, where said tube has an outside diameter of about 0.7 millimeters.

9. The apparatus of claim 7, where said tube has a length of about 4-4.5 millimeters.

10. The apparatus of claim 7, where said tube is configured to have a crossover point of about 1.0-1.5 kHz.

11. An apparatus, comprising:

a first audio driver having a first output in audio communication with a chamber;

a tube having a first end in audio communication with said chamber and a second end in audio communication with a combining chamber, where said tube is positioned generally perpendicular in relation to said first output; and a second audio driver having a second output in audio communication with said combining chamber.

12. The apparatus of claim 11, further comprising a boot assembly defining said chamber.

13. The apparatus of claim 12, further comprising a housing defining at least a portion of said combining chamber and enclosing said boot assembly.

14. The apparatus of claim 11, further comprising a housing having an extension protruding outwardly from a portion of said housing.

15. The apparatus of claim 14, further comprising a hook assembly protruding outwardly from said housing extension.

16. The apparatus of claim 15, where said hook assembly includes a flexible wire.

17. The apparatus of claim 11, further comprising a housing forming at least a portion of said combining chamber, where said housing includes an aperture for receiving said second end of said tube and a port in communication with said combining chamber.

18. The apparatus of claim 11, where said combining chamber is in audio communication with an acoustic damper.

19. A method of manufacturing an audio device for an ear, comprising:

arranging a first audio driver such that a first audio output is in audio communication with a chamber;

placing a tube in audio communication with said chamber and a combining chamber, where said tube is positioned in a general perpendicular orientation in relation to said first audio output; and arranging a second audio driver such that a second audio output is in audio communication with said combining chamber.

20. The method of claim 19, where said first audio driver and said second audio driver are secured in a boot assembly.

21. The method of claim 19, where said first output comprises a spout and said first audio driver is positioned in a boot defining said chamber such that an opening of said spout is sealed in said chamber.

22. The method of claim 19, further comprising forming said combining chamber in a housing of said audio device.

23. The method of claim 19, further comprising placing an acoustic damper in audio communication with said combining chamber.

24. The method of claim 19, where said tube is tuned to roll off frequencies above approximately 1.0-1.5 KHz.

25. The method of claim 19, further comprising connecting a low pass crossover to said first audio driver and a high pass crossover to said second audio driver.

26. An audio device for an ear, comprising:

a first audio driver positioned in a body in a first orientation having a first output positioned in an acoustic channel defined in said body;

a tube positioned in said body having a first end positioned in said acoustic channel defined in said body and a second end extending into a combining chamber defined in said body; and a second audio driver positioned in said body in a second orientation in relation to said first audio driver having a second output connected with said combining chamber.

27. The audio device of claim 26, further comprising at least one cylinder positioned in said acoustic channel.

28. The audio device of claim 26, further comprising at least one acoustic damper positioned in said acoustic channel.

29. The audio device of claim 26, further comprising at least one baffle positioned in said acoustic channel.

30. The audio device of claim 26, further comprising at least one constriction member positioned in said acoustic channel.

31. An earphone, comprising:

a housing;

a boot assembly positioned in said housing;

a first audio driver positioned in said boot assembly such that a first output of said first audio driver is in audio communication with a chamber in said boot assembly;

a second audio driver positioned in said boot assembly such that a second output of said second audio driver is in audio communication with a combining chamber in said boot assembly; and a tube positioned in said boot assembly having a first end in audio communication with said chamber and a second end in audio communication with said combining chamber.

32. The earphone of claim 31, further comprising an acoustic damper in audio communication with said combining chamber.

33. The earphone of claim 31, where said housing includes a nozzle protruding outwardly from a surface of said housing and a detachable ear tip is connected to an end of said nozzle.

34. The earphone of claim 31, where said tube is configured to act as a low pass filter.

35. The earphone of claim 34, where said low pass filter passes audio frequencies as a function of a length of said tube and a diameter of an aperture running through said tube.

36. The earphone of claim 31, further comprising a low pass crossover connected with a first input of said first audio driver and a high pass crossover connected with a second input of said second audio driver.

37. The earphone of claim 31, where said first audio driver comprises a dual balanced armature.

* * * * *